US008602157B2

(12) United States Patent
Luttig et al.

(10) Patent No.: US 8,602,157 B2
(45) Date of Patent: Dec. 10, 2013

(54) Q4 MUFFLER ASSEMBLY

(71) Applicants: George Luttig, Ontario (CA); Don Emler, Rancho Dominguez, CA (US)

(72) Inventors: George Luttig, Ontario (CA); Don Emler, Rancho Dominguez, CA (US)

(73) Assignee: Don Emler, Rancho Dominiguez, CA (US)

( * ) Notice: Subject to any disclaimer, the term of this patent is extended or adjusted under 35 U.S.C. 154(b) by 0 days.

(21) Appl. No.: 13/668,949

(22) Filed: Nov. 5, 2012

(65) Prior Publication Data

US 2013/0126266 A1 May 23, 2013

Related U.S. Application Data

(60) Provisional application No. 61/555,082, filed on Nov. 3, 2011.

(51) Int. Cl.
*F01N 13/08* (2010.01)

(52) U.S. Cl.
USPC ..... 181/227; 181/228; 181/212; 181/256; 181/272

(58) Field of Classification Search
USPC ..... 181/212, 227, 228, 256, 272
See application file for complete search history.

(56) References Cited

U.S. PATENT DOCUMENTS

| | | | | |
|---|---|---|---|---|
| 2,511,597 | A * | 6/1950 | Marx | 181/274 |
| 5,633,482 | A * | 5/1997 | Erion et al. | 181/282 |
| 8,151,932 | B2 * | 4/2012 | Inoue | 181/227 |
| 8,205,716 | B2 * | 6/2012 | Wirth | 181/269 |
| 8,215,450 | B2 * | 7/2012 | Chien | 181/269 |
| 8,292,026 | B2 * | 10/2012 | Tauschek et al. | 181/251 |
| 8,359,835 | B2 * | 1/2013 | Nishimura et al. | 60/289 |
| 2004/0178016 | A1 * | 9/2004 | Yamamoto et al. | 181/256 |

* cited by examiner

*Primary Examiner* — Forrest M Phillips
(74) *Attorney, Agent, or Firm* — Millen, White, Zelano & Branigan, P.C.

(57) ABSTRACT

A system for improved exhaust evacuation from an internal combustion engine made up of a core which is surrounded by an outer casing, an elongated tube, and a perforated chamber made up of two cup shaped portions. The first cup shaped portion is connected to an outlet tube and the second cup shaped portion is connected to the elongated tube. The second cup shaped portion has holes around the connection and the first cup shape portion does not.

7 Claims, 1 Drawing Sheet

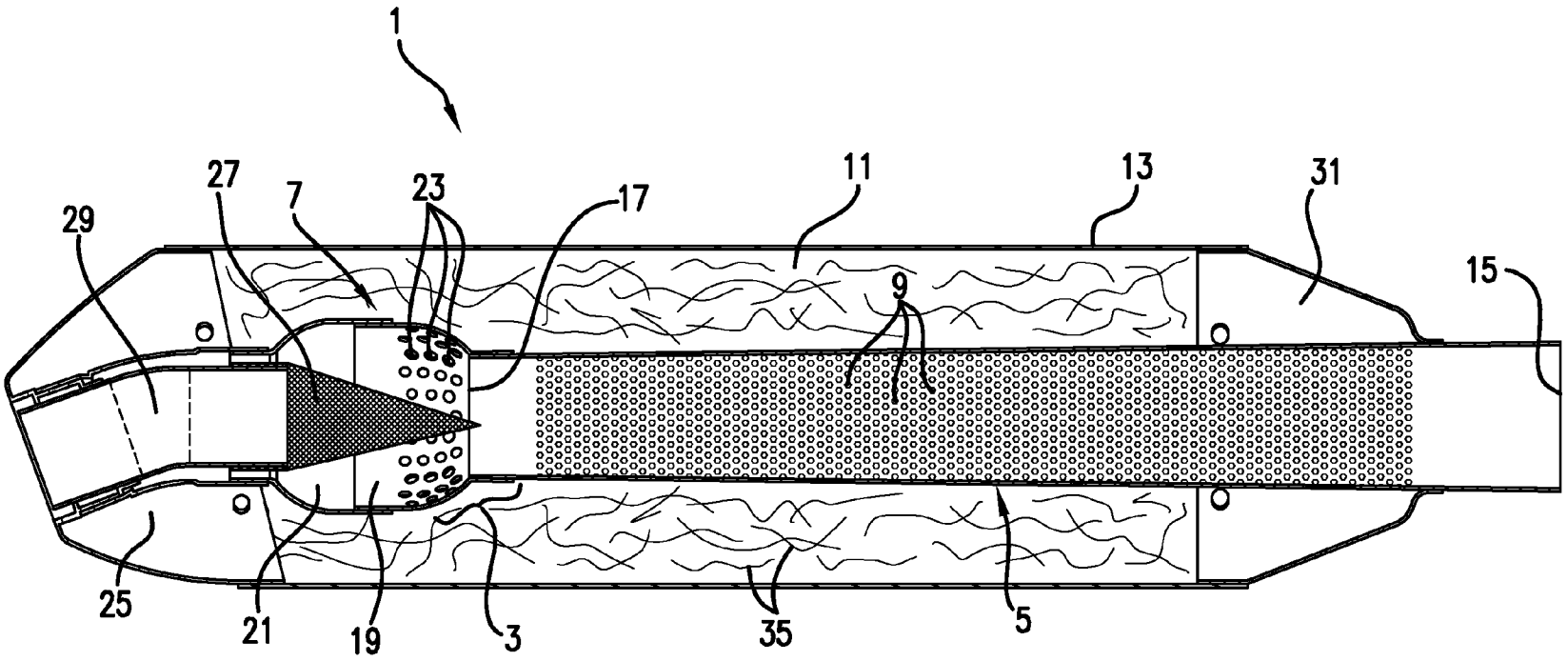
1
23
27
29
7
17
11
13
31
15
9
5
35
3
19
21
25

Q4 MUFFLER ASSEMBLY

This application claims benefit of Provisional application 61/555,082 filed Nov. 3, 2011, the entire disclosure of which is hereby incorporated by reference.

BACKGROUND

This invention relates to providing a system for improved exhaust evacuation from an internal combustion engine.

Internal combustion engines serve to power a majority of the powered vehicles worldwide. Typically, internal-combustion-driven vehicles comprise at least one system for transporting the exhaust gases from the combustion cylinder to at least one remote discharge point adjacent the vehicle. Commonly, the exhaust system will comprise a length of metallic pipe or similar fluid-transporting conduit. In most vehicles, the exhaust system will further include at least one sound-modifying device such as a muffler or silencer.

Typical "performance" mufflers, such as found on an off-road or road-going motorcycle, are mounted high and rearward on the vehicle. Preferably, a muffler should be located as close as possible to the center of vehicle mass (forward and downward). This preferred position improves vehicle handling by lessening the dynamic loads imposed on suspension systems by reducing the outer rotating mass of the vehicle.

In general, clearance for a muffler changes from front to rear based on a vehicle's amalgamation of fixed structures. On a motorcycle, the available room at the front of the muffler is dictated by the clearance between the rear tire, rear shock, sub-frame, brake components, and inside clearance beneath the side panels or number plate. Tire contact with a muffler will cause the muffler to move, thus weakening and eventually breaking the muffler mounts. Any contact with the vehicle frame, sub-frame, or shock will eventually cause a hole to develop at the point of wear. The side panels of most motorcycles are generally made from plastic; any contact with the muffler results in heat damage. Preferably, a muffler needs to have enough sound-absorbing media to attenuate combustion noise but not so little that the sound-absorbing media would need to be serviced too frequently. On a street or road bike, the clearance needs to be such as to allow for maximum lean angle while not making contact with the road surface causing damage to the muffler and loss of stability. A need exists for an improved muffler design that both increases the clearances between the vehicle, the muffler and the driving surface, and lessens dynamic loads imposed on suspension systems by reducing the outer rotating mass of the vehicle.

It is generally known that the performance of an internal combustion engine is affected by the fluid flow characteristics of the exhaust system. Generally, the less restrictive the system is to the passage of the exhaust gasses, the greater the performance of the engine.

Internal combustion engines operate by drawing power from a controlled explosion within a combustion cylinder. In a typical four-stroke combustion cycle, an intake mixture of air and fuel is drawn into the combustion cylinder, compressed, ignited to produce power, and finally discharged from the engine to the exhaust system. Generally, the amount of performance derived from the engine is directly related to the volume of air/fuel mixture that can be introduced into the combustion cylinder during each cycle. Restrictions in the exhaust system can prevent full evacuation of the combustion gases from the cylinder, resulting in an inability of the engine to fully recharge the cylinder with a subsequent volume of fuel/air mixture. Therefore, deriving maximum power from any engine requires an exhaust system designed with the free-flow of exhaust gases as a primary objective.

Unfortunately, exhaust systems often sacrifice flow in favor of other factors, for example, the reduction of sound emissions during operation.

Those who operate high performance vehicles are especially concerned with exhaust performance. Traditional methods of increasing performance of engines include increasing cylinder compression, valve modifications, and aggressive cam profiles. Each method has distinct disadvantages from the standpoint of heat generation, reliability, and engine longevity. Alternately, increasing the performance of the exhaust system may increase engine power output with relatively minor reductions in reliability.

A common practice used to meet closed course sound regulations in competitive motorcycle racing, is to use a very small diameter muffler core and an even smaller diameter outlet. The negative consequences of this arrangements is that low and mid RPM torque diminishes when compared to the performance characteristics of a large core, large outlet system.

A need exists for a muffler system to overcome this problem while fully complying with the requirements of the American Motorcyclist Association (AMA) and Federation Internationale de Motorcyclisme (FIM) closed course sound regulations.

Furthermore, due to increasing pressure from controlling bodies to set decibel sound limits for motorized vehicles operating within public lands, a need exists for a high-performance exhaust system that provides necessary reductions in sound emissions, while maintaining a high degree of performance.

SUMMARY OF THE INVENTION

A primary object and feature of the present invention is to provide a muffler system to overcome the above-mentioned problems.

It is a further object and feature of the present invention to provide such a muffler system for a high-performance internal combustion engine powered vehicle.

It is an additional object and feature of the present invention to provide such a muffler system that adapts to a range of vehicle applications.

It is a further object and feature of the present invention to provide such a muffler system that increases ground clearance in road-operated motorcycles.

It is a further object and feature of the present invention to provide such a muffler system that increases ground clearance in off-road operated motorcycles.

It is a further object and feature of the present invention to provide such a muffler system that improves weight distribution within a vehicle.

It is a further object and feature of the present invention to provide such a muffler system that reduces exhaust system weight.

It is another object and feature of the present invention to provide such a muffler system that comprises a reduced length muffler tip.

It is an additional object and feature of the present invention to provide such a muffler system that assists user system identification by means of a color-coded muffler tip.

It is yet another object and feature of the present invention to provide such a muffler system that comprises modular components.

It is a further object and feature of the present invention to provide such a muffler system that reduces backpressure within the exhaust system of an internal combustion engine.

It is a further object and feature of the present invention to provide such a muffler system that reduces backpressure within the exhaust system of an internal combustion engine using a uniquely shaped core.

It is a further object and feature of the present invention to provide such a muffler system that modifies the exhaust sound emissions while reducing backpressure within the exhaust system of an internal combustion engine by maximizing the cross-sectional area and interior surface area of the muffler core.

A further primary object and feature of the present invention is to provide such a muffler system that is efficient, inexpensive, and handy. Other objects and features of this invention will become apparent with reference to the following descriptions.

In accordance with a preferred embodiment hereof, this invention provides a muffler system related to the transport of at least one moving exhaust gas, such system comprising: at least one exhaust gas inlet to admit the at least one moving exhaust gas; at least one exhaust gas outlet to discharge the at least one moving exhaust gas; at least one exhaust gas transfer conduit adapted to transfer the at least one moving exhaust gas from such at least one exhaust gas inlet to such at least one exhaust gas outlet; and at least one outer housing adapted to essentially house such at least one exhaust gas transfer conduit; wherein such at least one outer housing comprises at least one outer periphery comprising at least one outer peripheral shape; wherein such at least one exhaust gas transfer conduit permits at least one unrestricted passage of at least one portion of the at least one moving exhaust gas from such at least one exhaust gas inlet to such at least one exhaust gas outlet along a linear axis of flow; and wherein preferably substantially each of such outer peripheral shapes of transverse sections taken at different points along such linear axis of flow is different from each other such outer peripheral shape taken at another transverse section.

Moreover, it provides such a muffler system wherein at least one of such outer peripheral shapes comprises an oval. Additionally, it provides such a muffler system wherein at least two of such outer peripheral shapes comprise ovals. Also, it provides such a muffler system wherein all of such outer peripheral shapes comprise ovals. In addition, it provides such a muffler system wherein at least one of such outer peripheral shapes comprises a circle. And, it provides such a muffler system wherein: such at least one outer periphery progresses smoothly from an oval outer peripheral shape to a round outer peripheral shape; and such smooth progression from such oval outer peripheral shape to such round outer peripheral shape is directed from such at least one exhaust gas inlet to such at least one exhaust gas outlet. Further, it provides such a muffler system wherein such at least one exhaust gas transfer conduit comprises at least one energy dissipater adapted to dissipate energy from the at least one pressure wave while the at least one moving exhaust gas is transferred by such at least one exhaust gas transfer conduit. Even further, it provides such a muffler system wherein such at least one exhaust gas transfer conduit comprises at least one square cross-section. Moreover, it provides such a muffler system wherein such at least one exhaust gas transfer conduit comprises at least one circular cross-section. Additionally, it provides such a muffler system wherein: at least one first portion of such at least one exhaust gas transfer conduit, adjacent such at least one exhaust gas inlet, comprises at least one first cross-sectional area no more than substantially equal to such at least one inlet cross-sectional area of such at least one exhaust gas inlet; at least one second portion of such at least one exhaust gas transfer conduit, adjacent such at least one first portion, steps up to at least one second cross-sectional area substantially larger than such at least one inlet cross-sectional area; and such at least one exhaust gas transfer conduit comprises at least one exhaust gas flow-accelerating portion. Also, it provides such a muffler system adapted to use with motorcycles. In addition, it provides such a muffler system adapted to use with all-terrain vehicles. And, it provides such a muffler system adapted to use with automobiles. Further, it provides such a muffler system adapted to use with personal watercraft. Even further, it provides such a muffler system adapted to use with aircraft.

In accordance with another preferred embodiment hereof, this invention provides a vehicular muffler system related to modifying at least one pressure wave of at least one moving exhaust gas passing through at least one muffler housing having at least one exhaust gas inlet to admit the at least one moving exhaust gas, and at least one exhaust gas outlet to discharge the at least one moving exhaust gas, such system comprising: a single exhaust gas transfer passage adapted to transfer the at least one moving exhaust gas between the at least one exhaust gas inlet and the at least one exhaust gas outlet; wherein such single exhaust gas transfer passage comprises at least one cross-sectional area substantially greater than the cross-sectional area of the at least one exhaust gas inlet; and wherein such single exhaust gas transfer passage comprises a regular polygonal cross section. Moreover, it provides such a muffler system wherein such regular polygonal cross section comprises a square. Additionally, it provides such a muffler system wherein such regular polygonal cross section comprises a rectangle. Also, it provides such a muffler system wherein such at least one exhaust gas transfer passage comprises at least one energy dissipater adapted to dissipate energy from the at least one pressure wave while the at least one moving exhaust gas is transferred by such at least one exhaust gas transfer passage. In addition, it provides such a muffler system wherein such at least one energy dissipater comprises at least one gas permeable aperture within such at least one exhaust gas transfer passage. And, it provides such a muffler system adapted to use with motorcycles. Further, it provides such a muffler system adapted to use with all-terrain vehicles. Even further, it provides such a muffler system adapted to use with automobiles. Moreover, it provides such a muffler system adapted to use with personal watercraft. Additionally, it provides such a muffler system adapted to use with aircraft.

In accordance with another preferred embodiment hereof, this invention provides a vehicular muffler system related to modifying at least one pressure wave of at least one moving exhaust gas passing through at least one muffler housing having at least one exhaust gas inlet to admit the at least one moving exhaust gas, and at least one exhaust gas outlet to discharge the at least one moving exhaust gas, such system comprising: at least one exhaust gas transfer passage adapted to transfer the at least one moving exhaust gas between the at least one exhaust gas inlet and the at least one exhaust gas outlet; wherein at least one first portion of such at least one exhaust gas transfer passage, adjacent the at least one exhaust gas inlet, comprises at least one first cross-sectional area no more than substantially equal to such at least one inlet cross-sectional area of the at least one exhaust gas inlet; wherein at least one second portion of such at least one exhaust gas transfer passage, adjacent the at least one first portion, steps up to at least one second cross-sectional area substantially larger than such at least one first cross-sectional area; wherein at least one third portion of such at least one exhaust gas transfer passage, adjacent the at least one exhaust gas outlet, comprises at least one third cross-sectional area no more than substantially equal to such at least one inlet cross-sectional area of the at least one exhaust gas inlet; and wherein such at least one exhaust gas transfer passage permits at least one unrestricted linear passage of at least one portion of the at least one moving exhaust gas from the at least one exhaust gas inlet to the at least one exhaust gas outlet.

Also, it provides such a muffler system wherein such at least one exhaust gas transfer passage comprises at least one exhaust gas flow-accelerating portion. In addition, it provides such a muffler system wherein such at least one exhaust gas flow-accelerating portion comprises at least one fourth portion of such at least one exhaust gas transfer passage, situate between such at least one first portion and such at least one second portion, comprising at least one fourth cross-sectional area substantially less than such at least one first cross-sectional area. And, it provides such a muffler system wherein such at least one exhaust gas flow-accelerating portion is accomplished per "Venturi"-type constriction.

Further, it provides such a muffler system wherein: the at least one exhaust gas outlet comprises at least one outlet cross-sectional area substantially less than the at least one inlet cross-sectional area; and at least one fifth portion of such at least one exhaust gas transfer passage, situate between such at least one third portion and the at least one exhaust gas outlet, comprises at least one fifth cross-sectional area no more than substantially equal to such at least one outlet cross-sectional area of the at least one exhaust gas outlet. Even further, it provides such a muffler system wherein such at least one exhaust gas transfer passage further comprises at least one energy dissipater adapted to dissipate energy from the at least one pressure wave as the at least one moving exhaust gas is transferred by such at least one exhaust gas transfer passage. Moreover, it provides such a muffler system wherein such at least one second portion comprises at least one gas expansion chamber adapted to permit expansion of the at least one pressure wave during the transfer by such at least one exhaust gas transfer passage.

Additionally, it provides such a muffler system wherein at least one portion of such at least one exhaust gas transfer passage comprises at least one regular polygonal cross-section. Also, it provides such a muffler system wherein such at least one regular polygonal cross-section comprises at least one square cross-section. In addition, it provides such a muffler system adapted to use with motorcycles. And, it provides such a muffler system adapted to use with all-terrain vehicles. Further, it provides such a muffler system adapted to use with automobiles. Even further, it provides such a muffler system adapted to use with personal watercraft. Moreover, it provides such a muffler system adapted to use with aircraft.

In accordance with another preferred embodiment hereof, this invention provides a muffler system, related to providing a tip system for directing exhaust gases from a muffler system having at least one fluid outlet comprising an effective radius R, comprising, in combination: at least one gas outlet adapted to modify and direct fluid flow out of the muffler system; wherein such at least one gas outlet comprises at least one attachment adapted to attach such at least one gas outlet to the at least one fluid outlet, and at least one director, extending outward an average distance D from such at least one attachment, adapted to direct such exhaust gases; wherein such average distance D is no more than about R; and wherein such at least one gas outlet comprises blue-anodized titanium.

In accordance with another preferred embodiment hereof, this invention provides a muffler system, related to modifying at least one pressure wave of at least one moving fluid, such system comprising: at least one fluid inlet to admit the at least one moving fluid; at least one fluid outlet to discharge the at least one moving fluid; at least one fluid transfer conduit adapted to transfer the at least one moving fluid from such at least one fluid inlet to such at least one fluid outlet; at least one energy dissipater adapted to dissipate energy from the at least one pressure wave during such transfer of the at least one moving fluid by such at least one fluid transfer conduit; wherein such at least one energy dissipater comprises at least one collection chamber, having length L, for collecting at least one portion of the at least one pressure wave, and at least one aperture adapted to pass the at least one portion of the at least one pressure wave from such at least one fluid transfer conduit to such at least one collection chamber; and wherein such at least one aperture comprises an effective diameter of at least 5% of such length L. Additionally, it provides such a muffler system wherein such at least one aperture comprises two apertures each having an effective diameter of at least 5% of such length L. Also, it provides such a muffler system wherein such at least one fluid inlet is connected to at least one exhaust header. In addition, it provides such a muffler system further comprising: at least one exhaust muffler; wherein such at least one fluid outlet is connected to permit fluid transfer with such at least one exhaust muffler. And, it provides such a muffler system adapted to use with motorcycles.

In accordance with another preferred embodiment hereof, this invention provides a muffler system, related to modifying at least one pressure wave of at least one moving fluid, such system comprising: at least one fluid inlet to admit the at least one moving fluid; at least one fluid outlet to discharge the at least one moving fluid; at least one fluid transfer conduit, comprising a first fluid-impervious-boundary-surface, adapted to transfer the at least one moving fluid from such at least one fluid inlet to such at least one fluid outlet; at least one energy dissipater adapted to dissipate energy from the at least one pressure wave during such transfer of the at least one moving fluid by such at least one fluid transfer conduit; wherein such at least one energy dissipater comprises at least one collection chamber for collecting at least one portion of the at least one pressure wave, and at least one aperture adapted to pass the at least one portion of the at least one pressure wave from such at least one fluid transfer conduit to such at least one collection chamber; and wherein at least one portion of such first fluid-impervious-boundary-surface is situate within such at least one collection chamber; wherein such at least one portion of such first fluid-impervious-boundary-surface comprises a boundary surface area; and wherein such at least one aperture comprises an effective area not exceeding 15% of such boundary surface area. Further, it provides such a muffler system wherein: such at least one collection chamber comprises at least one second fluid-impervious-boundary-surface; and such at least one second fluid-impervious-boundary-surface is substantially arcuate in shape. Even further, it provides such a muffler system wherein: such at least one aperture comprises less than sixteen apertures; at least one of such at least one apertures comprises an effective diameter of greater than about 0.3"; and at least one of such at least one apertures comprises an effective diameter of less than about 0.3". Moreover, it provides such a muffler system wherein: such at least one aperture comprises at least two apertures each one of such at least two apertures having an effective diameter greater than about 0.3"; and such at least one aperture further comprises a plurality of apertures each having an effective diameter less than about 0.3". Additionally, it provides such a muffler system wherein such at least one fluid inlet is connected to at least one exhaust header. Also, it provides such a muffler system further comprising: at least one exhaust muffler; wherein such at least one fluid outlet is in fluid communication with such at least one exhaust muffler.

In addition, it provides such a muffler system adapted to use with motorcycles. And, it provides such a muffler system adapted to use with all-terrain vehicles. Further, it provides such a muffler system adapted to use with automobiles. Even further, it provides such a muffler system adapted to use with personal watercraft. Even further, it provides such a muffler system adapted to use with aircraft.

In accordance with another preferred embodiment hereof, this invention provides a muffler system related to modifying at least one pressure wave of at least one moving exhaust gas discharged from at least one exhaust port of at least one internal combustion engine, such system comprising: at least one header pipe adapted to receive the at least one moving exhaust gas discharged from the at least one exhaust port; at least one muffler adapted to receive the at least one moving exhaust gas discharged from such at least one header pipe; wherein such at least one header pipe comprises at one first gas expansion chamber adapted to permit expansion of the at least one pressure wave during the transfer by such at least one header pipe; and wherein such at least one muffler comprises at one second gas expansion chamber adapted to permit expansion of the at least one pressure wave during the transfer by such at least one muffler. Even further, it provides such a muffler system wherein such at one first gas expansion chamber comprises: at least one fluid inlet to admit the at least one moving exhaust gas; at least one fluid outlet to discharge the at least one moving exhaust gas; at least one exhaust gas transfer conduit, comprising a first fluid-impervious-boundary-surface, adapted to transfer the at least one moving exhaust gas from such at least one exhaust gas inlet to such at least one exhaust gas outlet; at least one energy dissipater adapted to dissipate energy from the at least one pressure wave during such transfer of the at least one moving exhaust gas by such at least one exhaust gas fluid transfer conduit; wherein such at least one energy dissipater comprises at least one collection chamber for collecting at least one portion of the at least one pressure wave, and at least one aperture adapted to pass the at least one portion of the at least one pressure wave from such at least one exhaust gas transfer conduit to such at least one collection chamber; and wherein at least one portion of such first fluid-impervious-boundary-surface is situate within such at least one collection chamber; wherein such at least one portion of such first fluid-impervious-boundary-surface comprises a boundary surface area; and wherein such at least one aperture comprises an effective area not exceeding 15% of such boundary surface area.

Even further, it provides such a muffler system wherein such at least one muffler comprises: at least one exhaust gas inlet to admit the at least one moving exhaust gas from such at least one header pipe; at least one exhaust gas outlet to discharge the at least one moving exhaust gas; at least one exhaust gas transfer conduit adapted to transfer the at least one moving exhaust gas from such at least one exhaust gas inlet to such at least one exhaust gas outlet; and at least one outer housing adapted to essentially house such at least one exhaust gas transfer conduit; wherein such at least one outer housing comprises at least one outer periphery comprising at least one outer peripheral shape; and wherein such outer peripheral shape of a first transverse section taken at any point along such linear axis of flow is unique relative to such outer peripheral shape derived from a second transverse section taken at any other point along the same linear axis of flow.

Furthermore, it provides such a muffler system adapted to use with motorcycles. Even further, it provides such a muffler system adapted to use with all-terrain vehicles. Even further, it provides such a muffler system adapted to use with automobiles. Even further, it provides such a muffler system adapted to use with personal watercraft. And, it provides such a muffler system adapted to use with aircraft.

BRIEF DESCRIPTION OF THE DRAWINGS

FIG. 1 shows a cut away view of embodiment A of a muffler system.

DETAILED DESCRIPTION OF THE DRAWINGS

The following detailed description will be accomplished by reference to preferred embodiments and will include Applicant's current best understanding of the theory of operation of preferred embodiments. However, Applicants do not regard themselves as bound, or their invention limited, by any particular theory of operation expressed herein, as some uncertainties exist, even in the underlying science itself.

FIG. 1 shows a cross sectional view of a muffler system 1. Muffler system 1 has a core 3. Core 3 is made up of an elongated tube 5 and a chamber 7. The elongated tube and chamber may vary in size independently depending on vehicle and desired result.

The elongated tube 5 may optionally be straight or tapered to varying degrees. The diameter of the elongated tube 5 may be from 1 inch to 4 inches and preferably 2 inches to 3.5 inches. The length of the elongated tube 5 may be from 1 inch to 18 inches and preferably from 2.5 inches to 6 inches. The elongated tube 5 has a plurality of perforations 9 which permit fluid communication of exhaust gases between the elongated tube 5 of core 3 and the interstitial space 11. The interstitial space 11 defines the area between the core 3 and the outer casing 13. The interstitial space 11 contains muffler packing 35 preferably glass fibers.

The elongated tube 5 has an inlet aperture 15. The inlet aperture 15 may be from 1 inch to 5 inches and preferably from 1.750 inches to 2.375 inches. The elongated tube 5 also has an outlet aperture 17 into chamber 7. The outlet aperture 17 may be from 1 inch to 5 inches and is preferably from 1.375 inches to 2 inches.

The core 3 is constructed from two cup shaped pieces (19 and 21) that are bonded together. The pieces are preferably metal and the bond is preferably a weld. Piece 19 attached to the elongated tube 5 has holes 23 in its outer wall that face toward elongated tube 5. Piece 21 does not have any holes in its outer wall but does attach to outlet tube 29. A screen 27 covers outlet end cap 25 and prevents material such as large sparks from escaping. The size of the holes 23 may vary independently from the size of the perforations 9 in the elongated tube 5. The diameter of the holes 23 and perforations 9 may be between 0.1 inches to 5 inches.

The outlet end cap 25 has outlet tube 29 that allows exhaust to exit the muffler system 1. The inlet end cap 31 surrounds the portion of the elongated tube 5 that connects with the rest of the exhaust system and receives exhaust into the muffler system 1. Both end caps 25 and 31 are preferably metal and are preferably bonded to the outer casing 13 of the core 3 by welding or a fastening means, for example bolts or screws.

The embodiment shown in FIG. 1 and described above is referred to as embodiment A. The embodiment shown in FIGS. 14-19 of provisional application 61/555,082 and described below is collectively referred to as embodiment B.

FIG. 3 through FIG. 11 of provisional application 61/555,082 shows the exterior shape of the vehicle muffler canisters. The exterior shape of the vehicle muffler canister is compatible with both embodiments A and B may be applied to both embodiments A and B. Although some of the FIGS. 3-11 and 26 show structures that overlap with those of embodiment B the discloser below regarding FIGS. 3-11 and 26 applies equally to the related structures of embodiment A. One of ordinary skill in the art would know how to replace the structures of embodiment B with the related structures of embodiment A.

The novel transitioning external shape of muffler system 104 is effective in permitting a centralizing of the muffler mass relative to the center of mass of the vehicle. Any mass located away from the engine (typically the approximate center of mass of a motorcycle) applies a rotational moment to the vehicle system, often making the vehicle unbalanced. The novel external shapes of muffler system 104 move the mass (muffler) closer to the engine, thus improving the overall handling and performance of the vehicle.

FIG. 3 of provisional application 61/555,082 shows a perspective view of muffler system 104, comprising an oval-to-round outer canister 112, according to a preferred embodiment of the present invention. Preferably, oval-to-round outer canister 112 comprises a generally elongated housing having a longitudinal axis 138 extending parallel with the axis of gas flow through the muffler. Preferably, oval-to-round outer canister 112 comprises an outer perimeter surface that smoothly transitions from a substantially circular outer portion 114 to a substantially oval outer portion 116, as shown.

Preferably, the outer sidewall 113 of oval-to-round canister 112 is constructed from a single, generally flat sheet that is shaped into an elongated, generally tubular form, as shown. Preferably, each end of oval-to-round canister 112 comprises either an inlet end-cap 118 or outlet end-cap 120, as shown. Preferably, circular outer portion 114 (at least herein embodying at least one exhaust gas outlet to discharge the at least one moving exhaust gas) is situated adjacent outlet end-cap 118, as shown. Preferably, oval outer portion 116 (at least embodying herein at least one exhaust gas inlet to admit the at least one moving exhaust gas) is situated adjacent removable inlet end-cap 120, as shown. Upon reading this specification, those of ordinary skill in the art will understand that, under appropriate circumstances, such as, for example, the use of a oval-to-round-type muffler in alternate vehicle chassis configurations, etc., other arrangements, such as, utilizing an oval shape at the outlet end of the muffler, use of other polygonal shapes, conic sections, etc., may suffice.

Preferably, the outer geometry of oval-to-round canister 112 is generated by forming outer sidewall 113 around the dissimilar outer peripheral shapes of inlet end cap 120 and outlet end cap 118, as shown. In so doing, oval-to-round canister 112 comprises a unique outer peripheral shape wherein essentially no two transverse cross sections are the same (at least embodying herein wherein substantially each of such outer peripheral shapes of transverse sections taken at different points along such linear axis of flow is different from each other such outer peripheral shape taken at another transverse section). This preferred canister arrangement permits the development of highly specialized muffler embodiments and directly contributes to providing improved vehicle clearance and weight distribution while maintaining maximum interior canister volume for flow/sound modification.

Preferably, outer sidewall 113 is formed from a durable and lightweight material. Preferably, outer sidewall 113 is construction from a substantially rectangular sheet, as shown. Preferred materials used to form sidewall 113 are selected based intended use and material cost. In performance embodiments of muffler system 104, sidewall 113 is preferably constructed from ASTM B 265 GR 2 titanium having a thickness of about 0.025". In alternate preferred embodiments, sidewall 113 is preferably constructed from aluminum or stainless steel. In alternate preferred embodiments where weight is critical to performance, sidewall 113 is preferably constructed from a carbon fiber composite. Upon reading this specification those of ordinary skill in the art will understand that, under appropriate circumstances, considering such issues as user preference, advances in technology, performance criteria, etc., other construction materials, such as mild steel, hybrid composites, metallic alloys, high-performance resins, fiberglass, molded polymers, etc., may suffice.

Preferably, oval-to-round canister 112 of muffler system 104 houses at least one internal exhaust transfer core 126 for transferring a flow of exhaust gas from inlet aperture 122 (see FIG. 6 of provisional application 61/555,082) to outlet aperture 124, as shown. Preferably, oval-to-round outer canister 112 is adapted to house a high performance straight-through core, as shown (at least embodying herein wherein such at least one exhaust gas transfer conduit permits at least one unrestricted passage of at least one portion of the at least one moving exhaust gas from such at least one exhaust gas inlet to such at least one exhaust gas outlet along a linear axis of flow). As described in later embodiments of the present invention, muffler system 104 preferably comprises a range of internal structures adapted to modify or alter the dynamics of the energy associated with passage of the exhaust gas flow through the system. Under appropriate circumstances, the oval-to-round canister design of muffler system 104 is adaptable to house a wide range of gas-flow modification technologies. As an example, oval-to-round canister design of muffler system 104 is adaptable to function as a hybrid sound energy absorption-type muffler or silencer. Upon reading this specification, those of ordinary skill in the art will understand that, under appropriate circumstances, considering issues such as user preference, advances in vehicle design, intended vehicle application, etc., the use of other muffler/sound modification technologies, in conjunction with the oval-to-round design, such as, for example, restrictors, reflectors, resonators, active and passive wave canceling structures, multi-channel cores, etc., may suffice.

FIG. 4 of provisional application 61/555,082 shows a side view of muffler system 104. FIG. 5 of provisional application 61/555,082 shows a top view of muffler system 104 according to a preferred embodiment of FIG. 3 of provisional application 61/555,082. Referring now to both FIG. 4 of provisional application 61/555,082 and FIG. 5 of provisional application 61/555,082, the side view of FIG. 4 of provisional application 61/555,082 most clearly illustrates the preferred inlet-to-outlet transition of oval-to-round canister 112 (at least embodying herein wherein such at least one outer housing comprises at least one outer periphery comprising at least one outer peripheral shape). The preferred transitioning profile of oval-to-round canister 112 (at least embodying herein at least one outer housing adapted to essentially house such at least one exhaust gas transfer conduit) directly contributes to providing improved vehicle clearance and weight distribution characteristics while maintaining maximum interior canister volume for flow/sound modification.

Preferably, two parallel edges of the rectangular sheet material comprising oval-to-round canister 112 are brought together to form a substantially tubular shape, as shown. Preferably, the two parallel edges are permanently joined at seam 128, as shown. Preferably, seam 128 extends longitudinally along the length of oval-to-round canister 112, as shown. Preferably, seam 128 is permanently formed, by welding, to maximize strength and durability. Upon reading this specification, those of ordinary skill in the art will understand that, under appropriate circumstances, such as intended use, advances in technology, cost, etc., other means of forming a permanent seam, such as folded interlocking, bonding, mechanically fastening, fusing, cohering, etc., may suffice.

Preferably, outlet end-cap 118 is permanently fastened to outer sidewall 113 using rivets 130, as shown. Preferably, rivets 130 pass though a reinforcing retaining band 132 before extending through outer sidewall 113 to secure outlet end-cap 118 in position, as shown. Preferably, retaining band 132 is constructed from 304 stainless steel having a thickness of about 0.024". Preferably, inlet end-cap 120 is removably fastened to outer sidewall 113 using six allen-head screws 134, as shown. Preferably, allen-head screws 134 pass though a similar reinforcing retaining band 132 before extending through outer sidewall 113 to removably secure inlet end-cap 120 in position, as shown. The preferred use of removable fasteners on at least one end of oval-to-round canister 112 permits convenient access to the interior of the canister for inspection and service. For example, it is common, in specific muffler arrangements, to inspect and replace sound attenuating packing material after a predetermined period of service.

FIG. 6 of provisional application 61/555,082 shows an end view of inlet end-cap 120 of muffler system 104. FIG. 7 of provisional application 61/555,082 shows an end view of outlet end-cap 118 of muffler system 104 according to a preferred embodiment. Referring now to both FIG. 6 of provisional application 61/555,082 and FIG. 7 of provisional application 61/555,082, with continued reference to the prior figures of provisional application 61/555,082, inlet end-cap 120 preferably comprises inlet aperture 122, as shown. Preferably, inlet aperture 122 is concentrically positioned on axis with circular outer portion 114 of oval-to-round canister 112, as shown. Inlet end-cap 120 may preferably comprise one or more alternate shapes depending on vehicle application. For example, inlet end-cap 120 of muffler system 104 comprises a shape that is elongated and generally conical. In first example vehicle 101, the conically shaped inlet end-cap 120 provides greater heel clearance for the rider, increases muffler volume, and in conjunction with the oval-to-round canister shape, permits improved positioning of muffler system 104 within the chassis, as shown. Additionally, conically shaped inlet end-cap 120 permits the interior core to be shifted toward the inlet to improve overall vehicle weight balance. Other vehicle specific embodiments of inlet end-cap 120 may be relatively flat in configuration as to not project beyond the end of outer sidewall 113. Upon reading this specification, those of ordinary skill in the art will now understand that, under appropriate circumstances, considering such factors as rider preference, advances in vehicle technology, intended vehicle application, etc., modifying of the inlet end-cap to include other shapes, sizes and application specific structures, such as mounting tabs, spring retainers, adapters, etc., may suffice.

Preferably, outlet end-cap 118 comprises outlet aperture 124 also about concentrically positioned on axis with circular outer portion 114 of oval-to-round canister 112, as shown. Preferably, outlet end-cap 118 comprises three internally threaded sockets 136 equally spaced about outlet aperture 124, as shown. Preferably, threaded sockets 136 are adapted to receive allen-head bolts used to removably retain modular end-cap 106 adjacent outlet end-cap 118. Preferably, both inlet end-cap 120 and outlet end-cap 118 are constructed from a durable and corrosion resistant material, preferably stainless steel, or titanium. Under appropriate circumstances, considering such issues as cost and intended use, both inlet end-cap 120 and outlet end-cap 118 may comprise alternate materials, such as, for example, cast or milled aluminum.

FIG. 8 of provisional application 61/555,082 shows a side view of muffler system 100, comprising oval-to-oval canister 111, according to another preferred embodiment of the present invention. Preferably, oval-to-oval canister 111 comprises an outer perimeter surface that smoothly transitions from a first oval-shaped end portion 115 to a second, non-congruent, oval-shaped end portion 117, as shown (at least embodying herein wherein such at least one outer housing comprises at least one outer periphery comprising at least one outer peripheral shape). Preferably, oval-to-oval canister 111 comprises an elongated housing having a longitudinal axis 138 extending generally parallel with the axis of gas flow through the muffler. The unique outer shape of oval-to-oval canister 111 directly contributes to providing improved vehicle clearance and weight distribution while maintaining maximum interior canister volume for flow/sound modification. Upon reading this specification, those of ordinary skill in the art will understand that, under appropriate circumstances, such as, for example, the use of an oval-to-oval muffler in alternate vehicle chassis configurations, other arrangements, such as, forming outer shapes using other conic sections, use of complex closed polygonal outer shapes, outer shaped derived from Bezier curves, etc., may suffice.

Preferably, each end of oval-to-oval canister 111 comprises either an inlet end-cap 119 or outlet end-cap 121, as shown. Preferably, the outer geometry of oval-to-oval canister 111 is generated by forming outer sidewall 123 around the dissimilar outer peripheral shapes of inlet end-cap 119 and outlet end-cap 121, as shown. By this means, oval-to-oval canister 111 comprises a unique outer peripheral shape wherein essentially no two transverse cross sections are the same (at least embodying herein wherein substantially each of such outer peripheral shapes of transverse sections taken at different points along such linear axis of flow is different from each other such outer peripheral shape taken at another transverse section). This preferred canister arrangement permits the development of highly specialized muffler embodiments capable of improving vehicle clearances and weight distribution.

Preferably, outer sidewall 123 (at least embodying herein at least one outer housing adapted to essentially house such at least one exhaust gas transfer conduit) is formed from a durable and lightweight material. Preferably, outer sidewall 123 is construction from a substantially rectangular sheet having a substantially thin and uniform thickness, as shown. As in the prior embodiment, preferred materials used to form outer sidewall 123 are selected based on intended use and material cost. In performance embodiments of muffler system 104, sidewall 123 is preferably constructed from ASTM B 265 GR 2 titanium having a thickness of about 0.025". In alternate preferred embodiments, sidewall 123 is preferably constructed from sheet aluminum or sheet stainless steel. In alternate preferred embodiments where weight is critical to performance, sidewall 123 is preferably constructed from one or more carbon fiber composites. Upon reading this specification those of ordinary skill in the art will understand that, under appropriate circumstances, considering such issues as user preference, advances in technology, performance criteria, etc., other construction materials and or sheet thicknesses, such as mild steel, hybrid composites, metallic alloys, high-performance resins, fiberglass, molded polymers, etc., may suffice.

Preferably, oval-to-oval canister 111 comprises an integral muffler mount 129 adapted to permit secure mounting to a vehicle.

Preferably, muffler mount 129 comprises a machined aluminum bracket having a mounting flange mechanically fastened to the interior of sidewall 123, as shown. Preferably, muffler mount 129 passes through slot aperture 131 formed within sidewall 123, as shown. The location of muffler mount 129 is determined by the mounting requirements of the vehicle. Upon reading the teachings of this specification, those of ordinary skill in the art will now understand that, under appropriate circumstances, considering such issues as user preference, intended use, etc., other mounting arrangements, such as the use of brackets integrally formed within the housing, cast brackets, wire clips, etc., may suffice. Furthermore, those with ordinary skill in the art will now understand that, under appropriate circumstances, considering such issues as vehicle type, in-service durability, muffler mounting position, etc., other muffler mounting methods, such as the use of removable brackets, OEM straps, removable mounting clips, wire rings, etc., may suffice.

FIG. 9 of provisional application 61/555,082 shows a perspective view of oval-to-oval canister 111 of FIG. 8 of provisional application 61/555,082. Preferably, sidewall 123 is joined to inlet end-cap 119 and outlet end-cap 121 using mechanical fasteners 109, as shown. Preferably, oval-to-oval canister 111 (at least embodying herein at least one outer housing adapted to essentially house such at least one exhaust gas transfer conduit) of muffler system 104 houses at least one internal exhaust transfer core 126 for transferring a flow of exhaust gas from inlet aperture 125 to outlet aperture 127, as shown. Preferably, oval-to-oval canister 111 is adapted to house a high performance straight-through core, as shown (at least embodying herein wherein such at least one exhaust gas transfer conduit permits at least one unrestricted passage of at least one portion of the at least one moving exhaust gas from such at least one exhaust gas inlet to such at least one exhaust gas outlet along a linear axis of flow). As described in later embodiments of the present invention, muffler system 104 preferably comprises a range of internal structures adapted to modify or alter the dynamics of the energy associated with passage of the exhaust gas flow through the system. Under appropriate circumstances, the oval-to-oval canister design of muffler system 104 is adaptable to house a wide range of gas-flow modification technologies.

FIG. 10 of provisional application 61/555,082 shows a diagram illustrating the perimeter shapes of a first end portion 133 and a second end portion 135 of the oval-to-oval canister of FIG. 8 of provisional application 61/555,082. Preferably, first end portion 133 (illustrated by dashed lines) and second end portion 135 comprise non-congruent ovals, as shown. It should be noted that, under appropriate circumstances, considering such issues as vehicle application, manufacturing methodologies, etc., the development of alternate end portion shapes, such as, mathematically defined ellipses, closed polygonal shapes, complex closed concave curves, etc., may suffice. Furthermore, the two end shapes may preferably share vertices, be confocal, or comprise a special rotation of one end axis relative to the other end axis.

Preferably, the end shapes of oval-to-oval outer canister 111 are selected to achieve a superior fit of the muffler canister to the vehicle. For example, an oval-to-oval outer canister 111 adapted for first example vehicle 101 comprises two distinctly dissimilar elliptical shapes, as shown. Preferably, the major axis of first end portion 133, indicated by arrows A-A, is preferably shorter than the major axis of second end portion 135 indicated by arrows A'-A'. Preferably, the minor axis of first end portion 133, indicated by arrows B-B, is wider than the minor axis of second end portion 135 indicated by arrows B'-B'. Forming a sidewall about first end portion 133 and second end portion 135 produces an outer peripheral shape wherein essentially no two transverse cross sections are the same. This preferred canister arrangement permits the development of highly specialized muffler embodiments capable of improving canister fit, vehicle clearances, and vehicle weight distribution.

FIG. 11 of provisional application 61/555,082 shows a section through shaped canister 139 of an example muffler according to another preferred embodiment of the present invention. Shaped canister 139 further illustrates the potential benefits of developing specialized outer housing shapes. In the example of FIG. 11 of provisional application 61/555,082, shaped canister 139 has been further adapted to fit closely within the vehicle structure 141 by further modifying the shape of outer sidewall 123*a*, as shown. Preferably, outer sidewall 123*a* smoothly transitions between each dissimilar end shape, as shown. Preferably, shaped canister 139 comprises additional intermediate shaping adapted to further match shaped canister 139 to vehicle structure 141 thus centralizing the mass of the muffler within vehicle structure 141, as shown. Again, the present invention produces a muffler system having a specialized outer peripheral shape wherein essentially no two transverse cross sections are the same.

As stated above, the embodiments shown in FIGS. 14-19 of provisional application 61/555,082 are collectively referred to as embodiment B.

FIG. 14 of provisional application 61/555,082 is a partial cut-away perspective view, of muffler system 104 comprising chambered core 152, according to a preferred embodiment of the present invention. Chambered core 152 comprises one of several preferred internal embodiments of muffler system 104. Preferably, chambered core 152 functions to efficiently transfer a flow of exhaust gas from inlet aperture 122 to an outlet aperture 124 (at least embodying herein at least one exhaust gas outlet), as shown. Preferably, outlet aperture 124 comprises an area of cross section about equal to the cross sectional area of inlet aperture 122. In vehicle applications having specific sound emission limits, outlet aperture 124 preferably comprises a sound reducing cross sectional area less than the cross sectional area of inlet aperture 122. The unique gas flow dynamics of chambered core 152 permits outlet aperture 124 to comprise a smaller area than inlet aperture 122 without significant reduction in flow performance through the muffler. Most preferably, outlet aperture 124 comprises a sectional area approximately equaling the cross sectional area of inlet aperture 122 with reduction of exhaust outlet areas controlled by end cap 145, as shown. In this manner, the overall performance of muffler system 104 can be "tuned" to match a required vehicle operating parameter by selection of an end cap having an outlet area adapted to produce the desired operating parameter.

Chambered core 152 is typically situated within outer casing 154, as shown. The outer casing 154 comprises a structure matching any of the canister configurations shown in figures of provisional application 61/555,082. Upon reading this specification, those of ordinary skill in the art will understand that, under appropriate circumstances, such as user preference, advances in technology, intended vehicle application, etc., other outer canister shapes, such as round, oval, square, polygonal, etc., used in combination with the chamber core arrangement, may suffice.

FIG. 15 of provisional application 61/555,082 shows a partial cut-away view of end receiver 143 adapted to receive chambered core 152 of FIG. 14 of provisional application 61/555,082. FIG. 16 of provisional application 61/555,082 shows a partial cut-away view of end receiver 143 coupled to chambered core 152. Referring to both FIG. 15 of provisional application 61/555,082 and FIG. 16 of provisional application 61/555,082, preferably, end receiver 143 is adapted to engage chambered core 152 to fix chambered core 152 within outer casing 154, as shown. Preferably, end receiver 143 comprises tube 147 that is welded to end cap 145, as shown. Preferably, the interior diameter of tube 147 is sized to permit chambered core 152 to fit within tube 147, as shown. Preferably, chambered core 152 is frictionally held by end cap 145 to permit removal of end cap 145 for inspection and servicing. Preferably, end cap 145 is formed from ASTM 265 titanium sheet having a thickness of about 0.027". Preferably, tube 147 comprises a section of titanium tube having a diameter of about 1 ¾" and a thickness of about 0.035". Upon reading the teachings of this specification, those of ordinary skill in the art will now understand that, under appropriate circumstances, considering such issues as user preference, intended use, etc., other end receiver arrangements, such as billet milled caps, cast caps, use of materials such as stainless steel, aluminum, alternated sheet gauges, etc., may suffice.

FIG. 17 of provisional application 61/555,082 shows a sectional view through the section 17-17 of FIG. 14 of provisional application 61/555,082. Preferably, chambered core 152 comprises, in section, an elongated tube having a plurality of shape transitions adjacent at least one enlarged chamber, as shown. Preferably, core wall 156 of chambered core 152 comprises a plurality of perforations 155, as shown. Preferably, perforations 155 permit fluid communication of exhaust gases between interior portion 158 (at least embodying herein at least one exhaust gas transfer conduit adapted to transfer the at least one moving exhaust gas from such at least one exhaust gas inlet to such at least one exhaust gas outlet) and interstitial space 160 located between chambered core 152 and outer casing 154 (at least embodying herein at least one outer housing adapted to essentially house such at least one exhaust gas transfer conduit), as shown. Typically, interstitial space 160 is packed with a gas-permeable sound-attenuating material 162 such as steel wool, fiberglass, ceramic fiber, or similar high temperature fibrous media, as shown. It should be noted that effective sound modification is also achieved without the use of any packing material.

Referring to now FIG. 18 of provisional application 61/555,082 with continued reference to FIG. 17 of provisional application 61/555,082, FIG. 18 of provisional application 61/555,082 shows a sectional diagram through chambered core 152 of FIG. 14 of provisional application 61/555,082. Preferably, chambered core 152 comprises a substantially straight-through design to permit a substantially uninterrupted transfer of gas flow 148 from inlet aperture 122 (at least embodying herein at least one exhaust gas inlet) to outlet aperture 124, as shown (at least embodying herein wherein such at least one exhaust gas transfer passage permits at least one unrestricted linear passage of at least one portion of the at least one moving exhaust gas from the at least one exhaust gas inlet to the at least one exhaust gas outlet).

Preferably, the first stage of chambered core 152, adjacent inlet aperture 122, comprises inlet portion 164, as shown. Preferably, inlet portion 164 comprises an essentially uniform inner diameter approximately matching the inner diameter of inlet aperture 122 (at least embodying herein wherein at least one first portion of such at least one exhaust gas transfer passage, adjacent the at least one exhaust gas inlet, comprises at least one first cross-sectional area no more than substantially equal to such at least one inlet cross-sectional area of the at least one exhaust gas inlet). Preferably, the second stage of chambered core 152 consists of accelerator portion 166, as shown. Preferably, accelerator portion 166 comprises a "Venturi"-type constriction of reduced sectional area, as shown (at least embodying herein wherein such at least one exhaust gas flow-accelerating portion comprises at least one fourth portion of such at least one exhaust gas transfer passage, situate between such at least one first portion and such at least one second portion, comprising at least one fourth cross-sectional area substantially less than such at least one first cross-sectional area). Preferably, accelerator portion 166 (at least embodying herein at least one exhaust gas flow-accelerating portion) functions to modify gas flow 148 by increasing its speed and, thereby, reducing its pressure generated against sound-attenuating material 162. The third stage of chambered core 152 preferably consists of chamber 168, as shown (at least embodying herein wherein at least one second portion of such at least one exhaust gas transfer passage, adjacent the at least one first portion, steps up to at least one second cross-sectional area substantially larger than such at least one first cross-sectional area). Applicant's understanding of the theory of operation is that, as the accelerated exhaust-gas pulse of gas flow 148 exits accelerator portion 166 and enters chamber 168, it "rolls" out in an annular (smoke ring) fashion, as shown. Preferably, chamber 168 prevents gas-pressure obstruction of the outlet of accelerator portion 166. Preferably, eddies 170 are created that roll along core wall 156, as shown. The flow dynamic of eddies 170 preferably aide in evacuation of chamber 168 between pulses and further function to minimize return waves that are generated as the exhaust pulse reflects off of the atmosphere at outlet aperture 124. Utilizing the above-described arrangements of chambered core 152 permits outlet portion 171, and or end cap 145 to comprise a smaller diameter than inlet portion 164 without significant reduction in flow performance. The preferred structure and arrangement of chambered core 152 produces low engine RPM performance matching a core of much larger cross sectional area while producing the reduced sound emissions associated with a much smaller core. This is equally beneficial at higher engine speeds where a smaller outlet matches the cam timing of most modern high output engines.

Preferably, the core entrance area of inlet portion 164 is about 1.5 times the outlet area at outlet aperture 124, as shown (at least embodying herein wherein at least one third portion of such at least one exhaust gas transfer passage, adjacent the at least one exhaust gas outlet, comprises at least one third cross-sectional area no more than substantially equal to such at least one inlet cross-sectional area of the at least one exhaust gas inlet and wherein at least one fifth portion of such at least one exhaust gas transfer passage, situate between such at least one third portion and the at least one exhaust gas outlet, comprises at least one fifth cross-sectional area no more than substantially equal to such at least one outlet cross-sectional area of the at least one exhaust gas outlet). Preferably, the ratio of inlet to outlet areas can be tuned to suit different engine performance requirements. Preferably, the cross sectional area of chamber 168 (at least embodying herein such at least one second portion comprises at least one gas expansion chamber adapted to permit expansion of the at least one pressure wave during the transfer by such at least one exhaust gas transfer passage) is about 1.7 times the core entrance area of inlet portion 164, as shown.

FIG. 19 of provisional application 61/555,082 shows a perspective view, illustrating a preferred perforated construction of chambered core 152, according to the embodiment of FIG. 14 of provisional application 61/555,082. Preferably, chambered core 152 (at least embodying herein at least one exhaust gas transfer passage adapted to transfer the at least one moving exhaust gas between the at least one exhaust gas inlet and the at least one exhaust gas outlet) is constructed from two stamp-formed sheets of complementary shape, as shown. Preferably, each side of chambered core 152 comprises a longitudinal seam 172 that is welded for durability, as shown. Preferably, chambered core 152 is constructed from at least one heat resistive, non-corroding material. Preferably, chambered core 152 is formed from a perforated sheet metal (at least embodying herein wherein such at least one exhaust gas transfer passage further comprises at least one energy dissipater adapted to dissipate energy from the at least one pressure wave as the at least one moving exhaust gas is transferred by such at least one exhaust gas transfer passage).

Preferred performance is achieved using a range of perforation sizes and spacing. Criteria used in selecting preferred perforation size and spacing includes the type of attenuating material 162 used (that is, apertures must be small enough to prevent passage of attenuating material 162 from interstitial space 160), and area of gas transfer required between chambered core 152 and interstitial space 160 (defining both aperture size and spacing and generally based on sound absorption requirements). As an example, chambered core 152 is preferably constructed from stainless steel sheet having a thickness of about 0.035", and a pattern of perforation holes having a diameter of about 0.117" on a stagger of about 0.156". In a second preferred example, as preferably used within certain high performance vehicle applications, chambered core 152 comprises a 30-mesh 304 stainless steel sheet comprising apertures having a diameter of about 0.0085". In other preferred embodiments, chambered core 152 comprises a perforated titanium material. Upon reading this specification, those of ordinary skill in the art will understand that, under appropriate circumstances, considering such issues as operator preference, sound attenuation requirements, intended vehicle application, etc., other core materials and perforation patterns, such as, for example, the use of larger or smaller diameter holes on a larger or smaller stagger, the use of mild steel, metallic alloys of aluminum, ceramics, etc., may suffice.

FIG. 26 of provisional application 61/555,082 shows a perspective view, illustrating modular end-cap 106, for use with exhaust system 100, according to a preferred embodiment of the present invention. Preferably, exhaust system 100 has been further refined by developing modular end-cap 106 to permit simple and efficient system tuning. Preferably, modular end-cap 106 comprises a one-piece, substantially disk-shaped body 186 having at least one exhaust outlet aperture 184, as shown. Preferably, exhaust outlet aperture 184 comprises a flow-directing extension 192 having an average projection length D, as shown. Preferably, flow-directing extension 192 directs the discharge of exhaust gasses exiting the muffler in a controlled manner, as shown. Preferably, flow-directing extension 192 projects generally outwardly from disk-shaped body 186, as shown. Preferably, modular end-cap 106 further comprises three mounting apertures 188 adapted to permit passage of mounting fasteners 190 (see FIG. 27 of provisional application 61/555,082).

Preferably, exhaust system 100 is tunable to the performance requirements of specific vehicle applications using the interchangeability feature of modular end-cap 106, as shown. Preferably, modular end-cap 106 enables the vehicle operator (or engine tuner), to quickly modify the flow/sound dynamics of exhaust system 100, by interchanging modular end-caps 106 of differing sized aperture outlets 184, as shown. This preferred feature permits muffler system 104 to comprise a fixed outlet aperture dimension that, for the present disclosure, may be defined as radius R. Preferably, modular end-cap 106 comprises three interchangeable variations, each variation comprising a specifically sized outlet aperture 184 (or insert). Additionally, modular end-cap 106 is adapted to house a spark-arresting feature to permit forest-legal vehicle operation. Upon reading this specification those of ordinary skill in the art will understand that under appropriate circumstances, considering such issues as user preference, advances in technology, intended application, etc., other end-cap configurations, such as the use of a single size end-cap in combination with apertured inserts, etc., may suffice.

Preferably, modular end-cap 106 comprises a high gas-flow variant having an outlet diameter of about 2", as shown. A second, modular end-cap 106 preferably comprises an outlet diameter of about 1 ¾" . For applications requiring sound attenuation and/or a controlled power-band for increased ground-to-tire traction, a third variant comprising an outlet diameter of about 1 ½" is provided. Preferably, the operator/tuner selects the appropriate modular end-cap 106 to tailor the vehicle's performance to a specific sound emission or power-band requirement.

Although applicant has described applicant's preferred embodiments of this invention, it will be understood that the broadest scope of this invention includes such modifications as diverse shapes and sizes and materials. Such scope is limited only by the below claims as read in connection with the above specification.

FIG. 27 of provisional application 61/555,082 is a graph showing the relative performances of embodiment A and embodiment B. In the last few years manufacturers have been able to increase the usable power across a more wide range of operating rpms. Embodiment B is designed to function in a more narrow rpm range. While embodiment B provides slightly more power in the middle range of engine speed, this power significantly drops off in the upper and lower rpm ranges.

Additionally, the perforations in embodiment B are located at the end where the exhaust is focused into the outlet. These perforations allow hot exhaust gasses to enter the glass packing at a very high velocity. This results in premature damage to the muffler packing. The chamber 7 in embodiment A has no perforations where the exhaust gases are focused into the outlet. This feature substantially increases the life of the muffler packing.

Further, many other advantages of applicant's invention will be apparent to those skilled in the art from the above descriptions and the below claims.

The invention claimed is:

1. A muffler system comprising:

a core which is surrounded by an outer casing wherein the core comprises, an elongated tube wherein said elongated tube is perforated and a chamber wherein said chamber comprises two cup shaped portions positioned between the elongated tube and an outlet tube wherein a first cup shaped portion is connected by a first connection to the outlet tube and wherein a second cup shaped portion is connected by a second connection to the elongated tube and wherein the second cup shaped portion has a plurality of holes around the second connection and the first cup shape portion has no holes around the first connection.

2. The muffler system of claim 1 wherein the two cup shaped portions are connected to each other.

3. The muffler system of claim 1 additionally comprising a screen positioned to cover a cup side opening in the outlet tube.

4. The muffler system of claim 1 wherein the outer casing contains muffler packing.

5. A muffler system comprising:

A core which is surrounded by an outer casing wherein the core comprises,

An elongate tube wherein said elongate tube is perforated and

A chamber wherein said chamber is attached to and positioned between the elongate tube and an outlet tube, wherein the chamber has curved walls and a greater maximum diameter than the elongate tube, and wherein the chamber is oriented along the same axis as the elongate tube and outlet tube, and Wherein a predetermined portion of the chamber has a plurality of holes wherein the predetermined portion is not the entire chamber.

6. The muffler system of claim 5 additionally comprising a screen positioned to cover a chamber side opening in the outlet tube.

7. The muffler system of claim 5 wherein the outer casing contains muffler packing.

* * * * *

UNITED STATES PATENT AND TRADEMARK OFFICE

CERTIFICATE OF CORRECTION

PATENT NO. : 8,602,157 B2
APPLICATION NO. : 13/668949
DATED : December 10, 2013
INVENTOR(S) : Luttig et al.

It is certified that error appears in the above-identified patent and that said Letters Patent is hereby corrected as shown below:

In the Claims

Claim 1, Column 18, Line 59 reads: "second connection to the elongated tube and" should read -- second connection to the elongated tube and wherein the cup shaped portions are oriented along the same axis as the elongated tube and outlet tubes, and --.

Signed and Sealed this
Fifteenth Day of April, 2014

Michelle K. Lee

Michelle K. Lee
*Deputy Director of the United States Patent and Trademark Office*